US005300948A

United States Patent [19]

Tsujido et al.

[11] Patent Number: 5,300,948

[45] Date of Patent: Apr. 5, 1994

[54] DISPLAY CONTROL APPARATUS

[75] Inventors: Yoshinori Tsujido; Eriko Tayaoka, both of Hyogo, Japan

[73] Assignee: Mitsubishi Denki Kabushiki Kaisha, Tokyo, Japan

[21] Appl. No.: 696,058

[22] Filed: May 6, 1991

[30] Foreign Application Priority Data

May 11, 1990 [JP] Japan ..... 2-122473

[51] Int. Cl.[5] ..... G09G 1/02

[52] U.S. Cl. ..... 345/189; 345/201

[58] Field of Search ..... 340/799, 800, 798, 814, 340/744, 750, 725, 723; 395/165, 164, 166, 163, 119; 345/185, 197, 189, 200, 201

[56] References Cited

U.S. PATENT DOCUMENTS

| | | | |
|---|---|---|---|
| 4,205,310 | 5/1980 | McMann, Jr. et al. | 340/800 |
| 4,562,435 | 12/1985 | McDonough et al. | 340/799 |
| 4,742,474 | 5/1988 | Knierim | 395/165 |
| 4,782,462 | 11/1988 | Kaplinsky et al. | 340/799 |
| 4,799,056 | 1/1989 | Hattori et al. | 340/799 |
| 4,928,253 | 5/1990 | Yamauchi et al. | 395/166 |
| 4,943,937 | 7/1990 | Kasano et al. | 340/799 |
| 5,062,057 | 10/1991 | Blacken et al. | 395/166 |
| 5,138,305 | 8/1992 | Tomiyasu | 340/814 |
| 5,142,276 | 8/1992 | Moffat | 340/799 |

FOREIGN PATENT DOCUMENTS 3804460 9/1988 Fed. Rep. of Germany .

OTHER PUBLICATIONS

"Transputer Technical Notes" by INMOS Limited, published by Prentice Hall, 1989.

*Primary Examiner*—Tommy P. Chin
*Assistant Examiner*—A. Au
*Attorney, Agent, or Firm*—Wolf, Greenfield & Sacks

[57] ABSTRACT

In a display apparatus equipped with a plurality of frame memories for keeping data to be used for display on a display section and an output logic for outputting the display data on the frame memories to the display section, for effective use to various CAD/CAM graphic applications, a switching operation for connection of the frame memories to the output logic is selectively effected through a software among a mode for connecting one of the frame memories to the output logic, a double-buffer mode for switching two of the frame memories at the timing of vertical retrace intervals and a mode for switching the plurality of frame memories at the timing of horizontal retrace intervals.

6 Claims, 6 Drawing Sheets

DISPLAY CONTROL APPARATUS

BACKGROUND OF THE INVENTION

1. Field of the Invention

The present invention relates to speeding-up and functional improvement of display apparatus.

2. Description of the Prior Art

The speeding-up of display apparatus is generally required in the fields of document-and-image treating systems such as OA systems and graphic treating systems such as CAD/CAM systems. Particularly, in the CAD/CAM fields executing high-speed simulation and the like, various efforts have been made for the speeding-up purposes. Of the conventional speeding-up techniques, the process-distributing method is widely used as one general speeding-up technique, and a study and realizable example of a distributed type graphic display are disclosed in "A transputer based distributed graphic display" (TRANSPUTER TECHNICAL NOTES, INMOS Limited, Prentice Hall, 1989, p170–204). Moreover, in the recent high-speed graphic work station and the like, the speeding-up of the drawing operation is made by dividing a frame memory.

Although in these conventional display apparatus the speeding-up can be realized due to the distributing technique, there is a problem, however, in that its hardware has a fixed arrangement which is not necessarily optimal for application to the CAD/CAM requiring various expressions. As the graphic applications in the CAD/CAM field, there are complicated three-dimensionally shaped shading display and high-speed two-dimensionally imaged animation display, for example. The former bears a heavy calculation load for the preprocessing such as coordinate transformation and calculation of surface brightness and on the other hand the latter bears a heavy load for the output-side processing such as image transfer on a frame memory. In order to try to make the speeding-up of both the displays in the graphic work station or the like, at the previous stage a plurality of calculation processors are coupled through pipe lines to each other and at the output stage a frame memory is divided into regions each of which is coupled to a writing processor. Thus, the system is equipped with a number of processors as illustrated in FIG. 9 so as to become large in scale and high in cost. In FIG. 9, EP represents a processor acting as a calculation means, MEM designates a memory, DP denotes a processor functioning as a display data writing means, and FMEM depicts a frame memory.

In addition, in the case of operating the above-described applications, a problem arises in terms of the processor efficiency due to deviation of the processing load.

SUMMARY OF THE INVENTION

The present invention has been developed in order to eliminate the above-mentioned problems and contemplates to provide a control method of a display apparatus which is effectively applicable to various CAD/CAM graphic applications.

Thus, in accordance with this invention, there is provided a control method of a display apparatus comprising a plurality of frame memories each keeping data for display on a display section, one or more display data writing means coupled to the frame memories, and an output logic for outputting the display data on the frame memories, the switching operation being selectively effected among a mode in which connection from the frame memories to the output logic is made by connecting a single frame memory to the output logic, a double-buffer mode in which a pair of frame memories are switched at the timing of the vertical retrace interval, and a mode in which a plurality of frame memories are switched at the timing of the horizontal retrace interval.

That is, according to a control method of a display apparatus of this invention, with processors acting as a plurality of display writing means or calculation means, a plurality of frame memories coupled thereto, and a display section being arranged, the connection between these frame memories and an output logic is flexibly switchable through a software and a connection mode is selected in response to each requirement for the above-described various applications, thereby allowing effective use of the hardware resources.

The above and other objects, features, and advantages of the invention will become more apparent from the following description when taken in conjunction with the accompanying drawings.

DESCRIPTION OF THE PREFERRED EMBODIMENT

Figure 1:
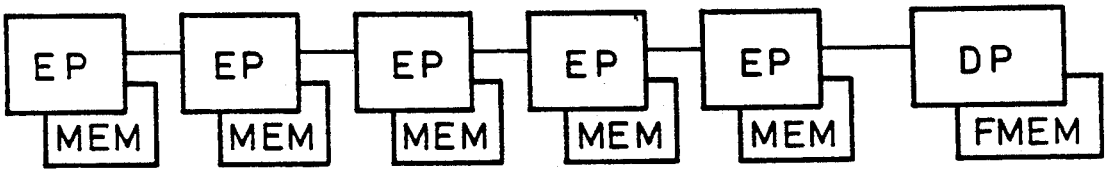
FIGS. 1, 2 and 3 are block diagrams showing a control method of a display apparatus according to an embodiment of this invention.
Figure 2:
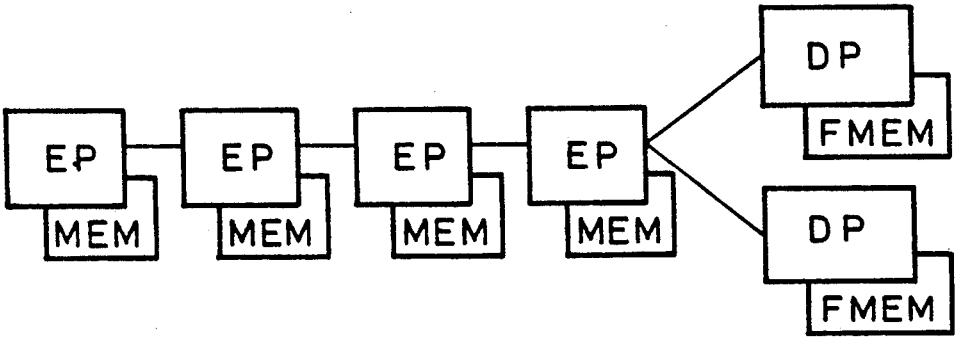
Figure 3:
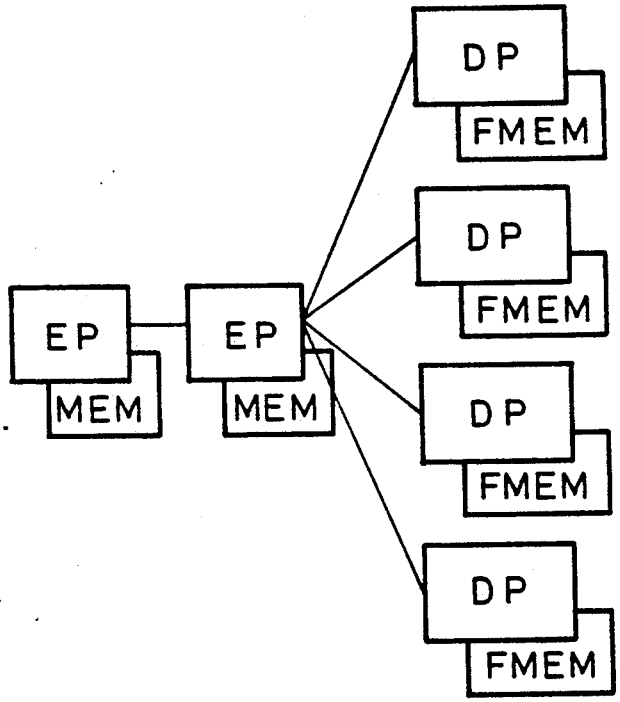

An embodiment of this invention will be described hereinbelow with reference to the drawings. Although according to the present invention some logical arrangements are allowed as illustrated in FIGS. 1 to 3, the description will be made in terms of the case of using six processors. In FIGS. 1 to 3, EP represents a processor acting as a calculation means, MEM designates a memory, DP depicts a processor functioning as a display data writing means and FMEM is a frame memory. Taking into account the load balance, these arrangements are employed for the above-mentioned complicated three-dimensionally shaped shading and high-speed two-dimensionally imaged animation. FIGS. 1 and 2 show the application to the three-dimensionally shaped shading and FIG. 3 illustrates the application to the high-speed two-dimensionally imaged animation. In FIG. 1, in the three-dimensionally shaped shading, five processors acting as the calculation means are assigned for the preprocessing heavy-loaded and one processor acting as the display data writing means is assigned for the display data writing processing which bears less load as compared with the preprocessing. Further, when using a three-dimensional shading algorithm where the load of the display data writing processing is relatively heavy as compared therewith or using the double-buffer, as illustrated in FIG. 2, four processors acting as the calculation means are assigned for the preprocessing and two processors acting as the display data writing means are assigned for the display data writing processing. In the case of using the double-buffer, one frame memory is coupled to the output logic, so that the display data are written in the other frame memory. During the vertical retrace interval following the completion of the writing operation, these frame memories are switched whereby it is possible to provide a flicker-free and smooth animation. Here, the processor of the frame memory side which is in the display operation can also be used as the calculation means. Still further, in the case of the two-dimensionally imaged animation where the load of the writing processing is heavy, as illustrated in FIG. 3, two processors are assigned so as to act as the calculation means and four processors are assigned to act as the display data writing means. When distributing the display data writing means as illustrated in FIGS. 2 and 3, if the frame memory for the display is switched at every horizontal operation (for example), the necessary writing region can be decreased up to ½ (FIG. 2) or ¼ (FIG. 3), thereby decreasing the writing load. As described above, according to this invention, the arrangement is flexibly switchable in accordance with the load variations of the calculation in the preprocessing and display data writing processing, thereby allowing the realization of a display apparatus with a high processor efficiency.

Figure 4:
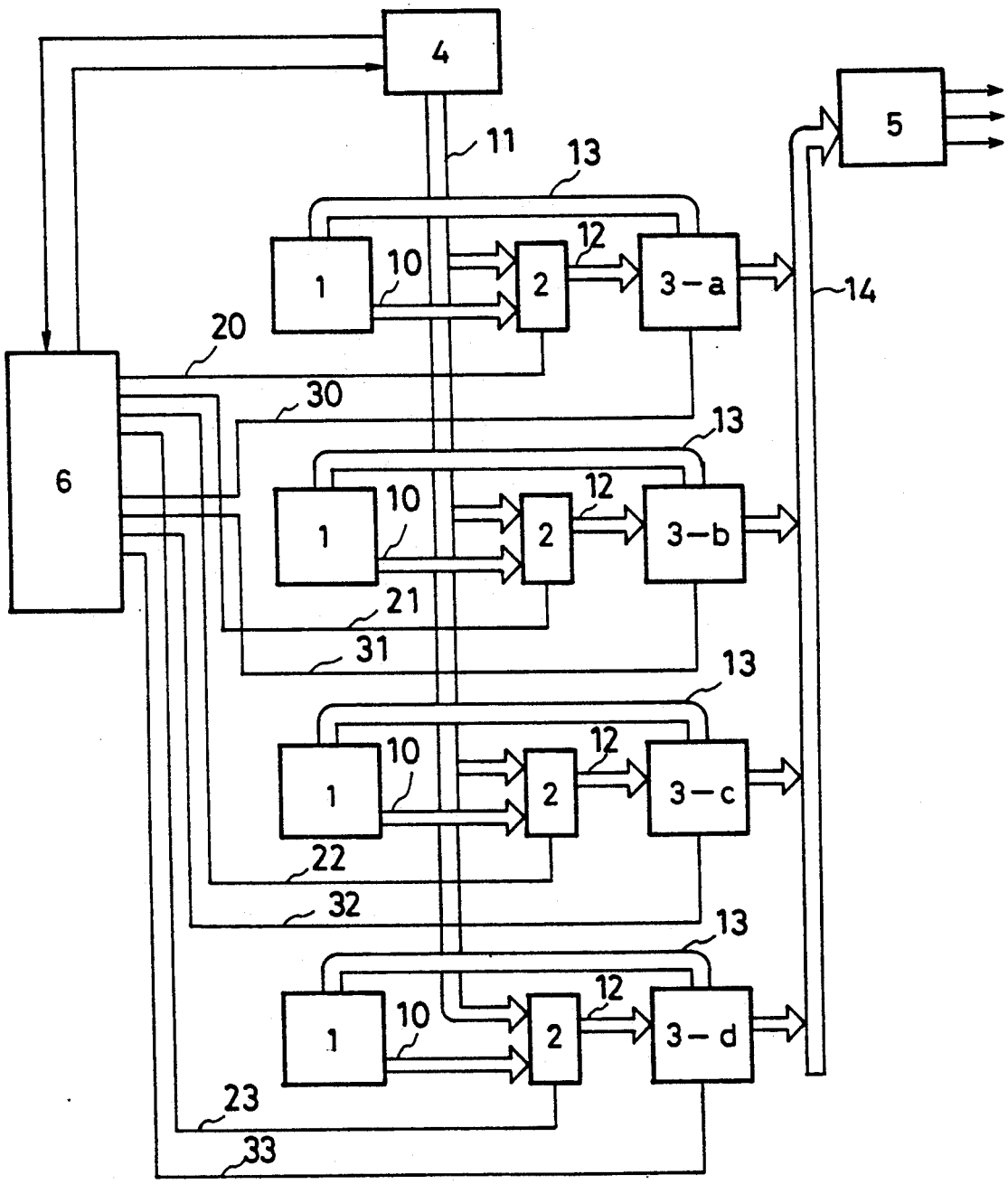
FIG. 4 is an illustration of a hardware for realizing the mode-switching operation in this embodiment by means of a software.

Secondly, a description will be made hereinbelow in terms of an arrangement of the hardware for realizing the flexible arrangement-switching operation. FIG. 4 shows one embodiment for the realization, where (1) represent processors, (2) designate address switching devices, (3-*a*) to (3-*d*) denote frame memories each comprising a dual-port memory having a serial output for the image output, (4) depicts a CRT controller for producing display addresses on the frame memories (3-*a*) to (3-*d*), (5) is an output logic, (6) represents a frame switching control device which is a principal element arranging this invention, (10) designate address buses for the processors (1), (11) depicts a display address bus for the CRT controller (4), (12) are address buses selected by the address switching devices (2) and coupled to the frame memories (3-*a*) to (3-*d*), (13) denote data buses each coupling the processor (1) to one of the frame memories (3-*a*) to (3-*d*), (14) represents an display output bus for the connection between the serial outputs of the frame memories (3-*a*) to (3-*d*) and the output logic (5), (20) to (23) are address-bus selecting signals for controlling the switching operation between the address buses (10) from the processors (1) and the address bus (11) from the CRT controller (4), and (30) to (33) are output enabling signals for controlling the serial outputs of the frame memories (3-*a*) to (3-*d*). Although in FIG. 4 two of the above-mentioned processors (1), the communication paths between the processors (1) and others are not illustrated, in order to realize the arrangements shown in FIGS. 1 to 3, two processors can fixedly be assigned as processors for the calculation means, and for the logical connection if a processor such as the transputer, i.e., the processor disclosed in the above-mentioned "A transputer based distributed graphic display" (TRANSPUTER TECHNICAL NOTES, INMOS Limited, Prentice Hall, 1989, p170–204) is used, it is possible to easily switch the arrangement by means of a software as described in the document. Here, a description will be made only in terms of four processors relating to the selective connection between the frame memories and the output logic.

In a description to be made with reference to FIGS. 5 to 8, an output control signal (an output enabling signal), illustrated at (30) to (33), for controlling the serial outputs of the frame memories will be described in accordance with the positive logic {H (high): enabling, L (low): disabling}.

Figure 5:
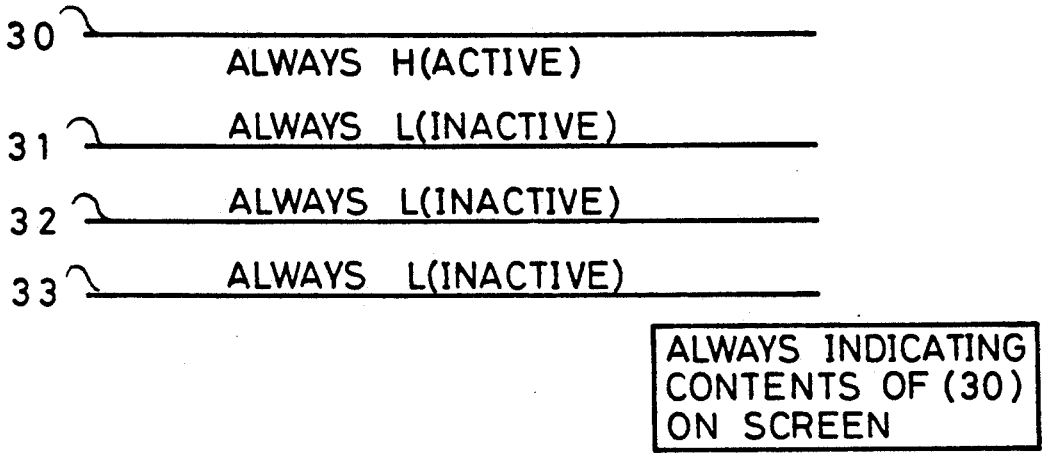
FIGS. 5 to 8 are illustrations for describing output enabling signals to be produced by a frame switching control device in order to realize the arrangements illustrated in FIGS. 1 to 3.

In FIG. 4, in order to realize the connection illustrated in FIG. 1, as shown in FIG. 5, only the output control signal (30) always takes the H-state and the output control signals (31) to (33) always take the L-states. Further, only the address selecting signal (20) is controlled in response to the display timing and the address selecting signals (21) to (23) are always controlled so as to effect the connection of the address (10) from the processor (1). Thus, only the frame memory (3-*a*) is always connected as a frame memory and the other processors (1) are used as the calculation means only.

Figure 6:
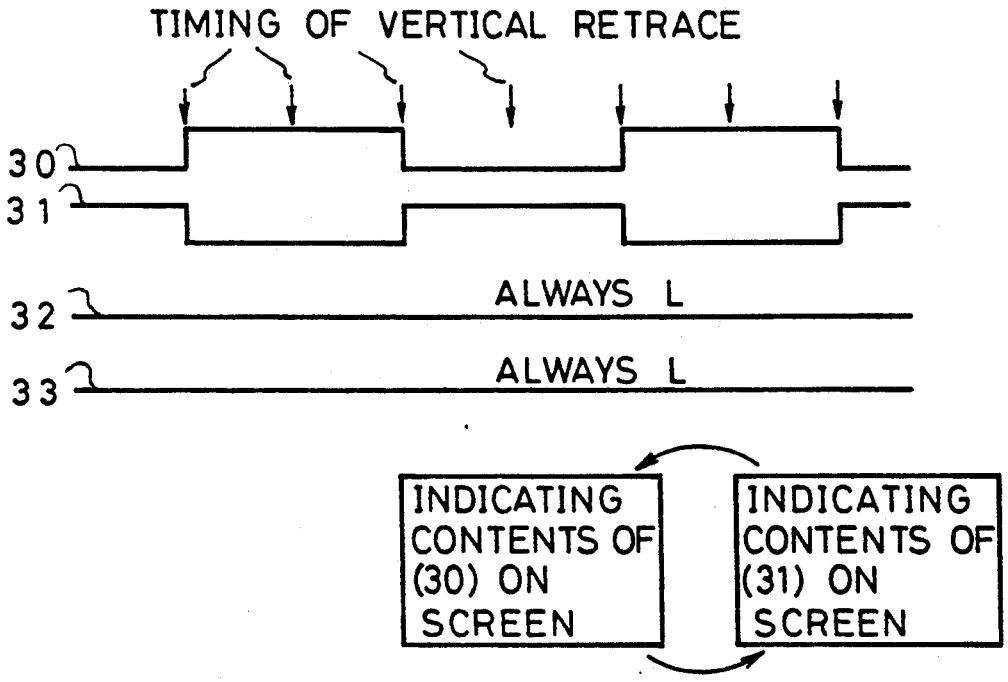

Of the FIG. 2 connections, in the case of using the double-buffer, as shown in FIG. 6 for instance, the switching operation between the H- and L-states of (30) and (31) is effected at the vertical retrace line timing after completion of the display updating. In response to this operation, the address selcting signals (20) and (21) are controlled at the display timing, whereby the frame memories (3-*a*) and (3-*b*) are switchable at the vertical retrace line timing.

Figure 7:
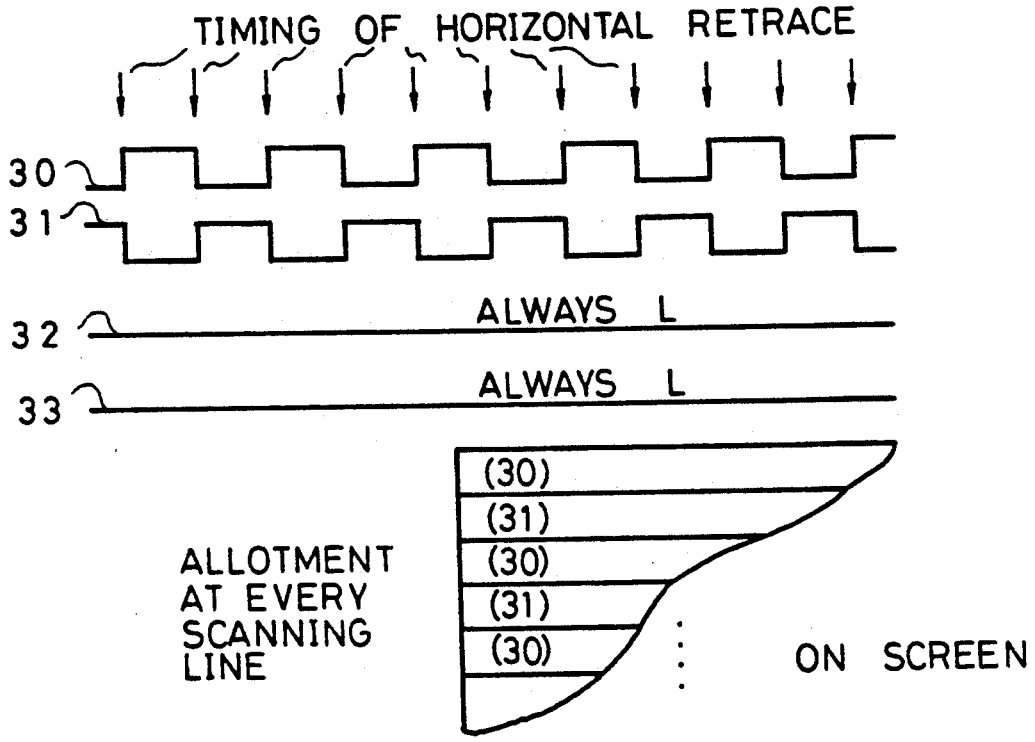

Of the FIG. 2 connections, in the case of distributing the frame memory, as illustrated in FIG. 7 for instance, (30) and (31) are switched at the timing of every horizontal retrace interval. In accordance with the switching operation, the address selecting signals (20) and (21) are controlled at the display timing, whereby the allotment of one picture is made fifty-fifty at every horizontal scanning line and hence the load necessary for the writing can be decreased up to ½.

Figure 8:
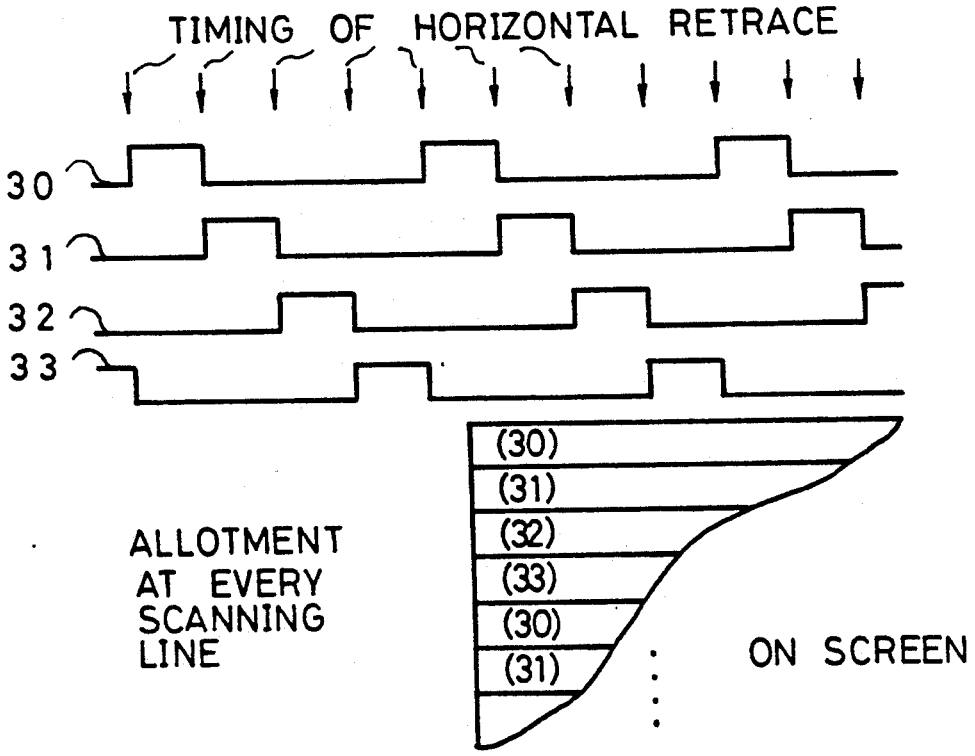
Figure 9:
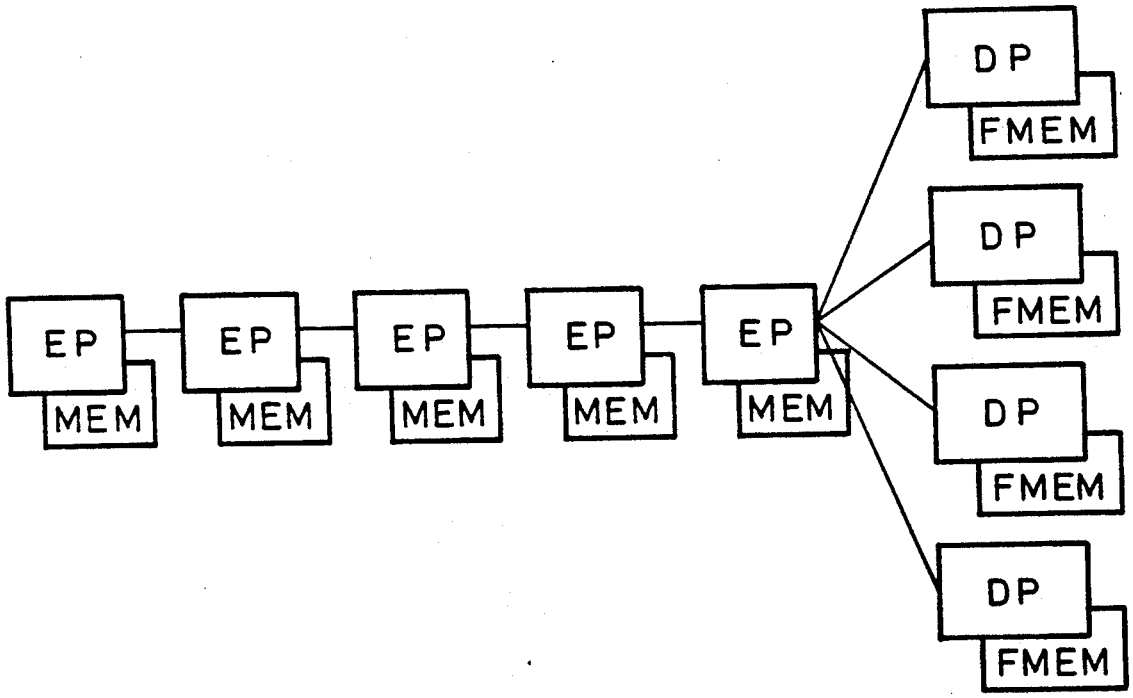
FIG. 9 PRIOR ART
FIG. 9 is an illustration of the Prior Art system.

In order to realize the FIG. 3 connection, as illustrated in FIG. 8 for instance, the output control signals (30) to (33) are arranged so as to take the H-state in order and the other signals are arranged to take the L-state. In accordance with this operation, the address selecting signals (20) to (23) are controlled at the display timing. Thus, the allotment of one screen is made to be ¼ each at every horizontal scanning line to thereby allows decrease of the writing load each up to ¼.

As described above, with the above-described simple control signal being produced by means of the frame switching control device (6), it is possible to perform such a flexible switching operation of the arrangement, while using the existing hardware elements it is an extremely simple technique Lo produce such a signal at the timing of the CRT controller and under software control of the processors, and hence the detailed description thereof would not be required here.

As described herein in terms of the double-buffer utilization with reference to FIG. 2, although it is realized through the switching of the frame memory, in the case of FIG. 1, when in FIG. 2 distributing the frame memory, similarly in FIG. 3, the realization can also be made with a method of changing the frame memory address for the start of display. Further, it is needless to say that no limitation is imposed on the numbers of the processors and frame memories illustrated.

As described above, if using the control method of a display apparatus according to the present invention, it is possible to provide the effect that the resources such as the processors can flexibly and effectively be used with respect to various applications.

What is claimed is:

1. A display control apparatus, responsive to a signal which is indicative of display data writing load, said apparatus comprising:

a plurality of frame memories for containing display data for display on a raster-scan display having a plurality of vertically consecutive display lines, a plurality of display data writing means for writing display data to said frame memories, an output display logic for receiving the display data from said plurality of frame memories and outputting the received display data to said display, and a frame switching control means for coupling at least one of said plurality of frame memories to said output display logic and having a first operational mode in which only one of said plurality of frame memories is coupled to said output display logic, a double-buffer operational mode in which two of said plurality of frame memories are alternately coupled to said output display logic at the timing of vertical retrace intervals of the raster-scan display, whereby the two frame memories supply display data to the output display logic in an alternating fashion and the output display logic outputs the received display data in alternating fashion, and a third operational mode in which at least two of the plurality of frame memories are successively coupled to said output display logic, at the timing of horizontal retrace intervals, whereby successive scan lines of the display are supplied display data from the at least two frame memories in successive fashion and having means for causing the frame switching control means to operate in one of said modes in response to the signal.

2. The display control apparatus as claimed in claim 1, characterized in that said frame memories each comprise a dual-port memory capable of generating a serial output of image data.

3. The display control apparatus as claimed in claim 1, characterized in that any one of said display data writing means comprises a processor.

4. The display control apparatus as claimed in claim 1, wherein during said double-buffer operational mode a first of said two frame memories is used as a double buffer, and a second of said two frame memories is coupled to said output display logic, and display data writing is effected to said first frame memory, and the coupling of said output display logic to the first of said frame memories is switched during the next vertical retrace interval after completion of the display data writing.

5. The display control apparatus as claimed in claim 1, characterized in that said frame switching control means is programmable.

6. A display control apparatus comprising a plurality of frame memories containing data for display on a raster-scan display having a plurality of vertically consecutive display lines, a plurality of display data writing means coupled to said plurality of frame memories for writing display data to said frame memories, an output display logic for outputting the display data from said frame memories to said display, a CRT controller which is connected to said frame memories when said frame memories are connected to said output display logic, and a frame switching control means for selectively coupling said frame memories to said output display logic and for selectively coupling either said CRT controller or said display data writing means to said frame memories, said frame switching control means having a first operational mode for connecting one of said frame memories to said output display logic and said CRT controller to one of said frame memories, a double-buffer operational mode for connecting a pair of frame memories from said plurality of frame memories to said output display logic and said CRT controller to said pair in an alternating, switched manner, the connections between said pair and the output display logic and the connections between said CRT controller and said pair being switched at the timing of vertical retrace intervals of the raster-scan display, and a third operational mode for selectively coupling said plurality of frame memories to said output display logic and for coupling said CRT controller to said plurality of frame memories, the coupling between said frame memories and the output display logic and the coupling between said CRT controller and said frame memories occurring at the timing of horizontal retrace intervals so that consecutive scan lines are supplied display data from successive frame memories.

* * * * *